US012053109B1

(12) United States Patent
Thorburn

(10) Patent No.: US 12,053,109 B1
(45) Date of Patent: Aug. 6, 2024

(54) DEVICE AND SYSTEM TO SECURE TEXTILES TO FIXED SURFACES

(71) Applicant: Karen E Thorburn, Ormond Beach, FL (US)

(72) Inventor: Karen E Thorburn, Ormond Beach, FL (US)

( * ) Notice: Subject to any disclaimer, the term of this patent is extended or adjusted under 35 U.S.C. 154(b) by 0 days.

(21) Appl. No.: 18/537,892

(22) Filed: Dec. 13, 2023

Related U.S. Application Data

(60) Provisional application No. 63/432,397, filed on Dec. 14, 2022.

(51) Int. Cl.
*A47G 21/16* (2006.01)

(52) U.S. Cl.
CPC ..... *A47G 21/167* (2013.01)

(58) Field of Classification Search
CPC ..... A47G 21/167; A47C 31/10; Y10T 24/23; Y10T 24/51; Y10T 24/155; Y10T 24/33
See application file for complete search history.

(56) References Cited

U.S. PATENT DOCUMENTS 4,432,120 A * 2/1984 Sherman, Jr. ..... B60K 15/04 24/304
5,090,095 A * 2/1992 Lightfoot ..... A47H 1/18 248/912
5,544,393 A * 8/1996 Lightfoot ..... A47H 13/04 248/912
5,987,708 A * 11/1999 Newton ..... B65D 33/1625 24/30.5 R
6,477,751 B2 * 11/2002 Baumdicker ..... A44B 99/00 24/716
6,675,449 B2 * 1/2004 Wales ..... A44B 99/00 24/546

* cited by examiner

*Primary Examiner* — Robert Sandy
(74) *Attorney, Agent, or Firm* — The Law Office of John R. Nelson, PA; John R. Nelson

(57) ABSTRACT

This invention relates to a device and system to securely fasten textiles to fixed surfaces. The device includes a holder with a malleable material on the bottom, allowing for easy one-handed operation. The device also has a top with a fastener attached for secure attachment to the fixed surface. The malleable material has intersecting slits to create an opening for inserting the textile. This device and system provide a solution that is reusable, does not require modifications to the textile, and can be used on surfaces and textiles of varying sizes. Overall, it offers an efficient and effective way to secure textiles to fixed surfaces, like keeping a tablecloth in place and preventing it from being blown away by the wind.

9 Claims, 18 Drawing Sheets

DEVICE AND SYSTEM TO SECURE TEXTILES TO FIXED SURFACES

RELATED APPLICATIONS

This application claims priority to U.S. Provisional Patent Application No. 63/432,397, filed on 14 Dec. 2022, which is incorporated herein by reference in its entirety, including any addendums, appendixes, and attachments thereto, to the extent these applications do not conflict with the present disclosure herein.

FIELD OF INVENTION

This invention relates to a device and system to secure textiles to fixed surfaces.

BACKGROUND

The following discussion is not to be deemed admitted prior art, but merely related art to show possible background and information related to devices or systems for securing textiles to fixed surfaces.

Textiles, as used herein, may be but not limited to, tablecloths, table runners, place mats, bedsheets, blankets, throws, tapestries, towels.

Fixed surfaces, as used herein, may be but not limited to, tables, picnic tables, desks, counter-tops, workbenches, shelves, display stands or podiums, outdoor decks.

To illustrate examples of potential embodiments without limiting their scope, the following description will discuss the use of the system in securing textiles to various fixed surfaces. Tablecloths and tables are used as examples, but it should be understood that the invention can be applied to other textiles and different types of stationary objects.

Tablecloths come in varying overhanging sizes, different materials, and different weights. Whether used indoors or outdoors, a tablecloth may drape off the edge of a table and be prone to movement.

When used outdoors, particularly with plastic tablecloths, it is a well-known problem that the tablecloth may lift in windy conditions. This can result in items on the table, such as decorations, cups with liquids, plates, and food, being knocked over.

Typically, an outdoor solution is strategically placing heavy items around the table to hold down the tablecloth.

Still, other solutions involve placing clamps on the tablecloth to the table, but these solutions require a clamp of the correct size. For example, some solutions use metal clamps that hold a tablecloth in place on a picnic table by utilizing the spring of the metal to engage picnic tables of certain thicknesses. The clamps are applied near the corners of the table to hold the tablecloth in place. A significant disadvantage of this device is that it is applicable to only a limited number of picnic tables having a tabletop of the proper thickness.

Still, other solutions have an apparatus comprising a tablecloth having weights disposed along its edge. Weights are sewn into a sleeve provided in the hem of the tablecloth so that, as the tablecloth lays draped over the table, opposing weights hanging down on both sides of the table hold it in place. This requires a specific tablecloth and table of a specific size ahead of time.

Still, other solutions use strips that can be released and are attached to opposite edges of the tablecloth using clamps or snaps. The strips are clamped or hooked under the table between the overhanging extending flaps of the tablecloth to hold the tablecloth in place.

Still, other solutions in the prior art for holding fabrics in place to furniture like tables and chairs provide for elastic gatherings of the fabric or drawstrings.

Each of these solutions fails to meet the needed solution because they are difficult to use, cumbersome, unreliable, require the securing device to be connected to the tablecloth, or are limited to tables of certain thickness and size.

Therefore, a need exists for a novel device and system to secure textiles to fixed surfaces.

BRIEF SUMMARY OF THE INVENTION

This invention relates to a device designed to securely fasten textiles to fixed surfaces without the need for modifications to the textile or permanent mounting to the fixed surface.

Numerous aspects of a unique device and system to secure textiles to fixed surfaces are disclosed.

It is desirable to have a device and system to secure textiles to fixed surfaces and keep the textile securely in place, preventing it from causing items on the fixed surface to fall over or spill, even on windy days. Additionally, it allows for easy removal for cleaning and re-use elsewhere and can also help alleviate irritation caused by textile overhang. Still, further, it is desirable to have a device and system to secure textiles to fixed surfaces that can be easily removed for cleaning and re-use elsewhere.

The disclosed device advantageously fills these needs and addresses the aforementioned deficiencies by providing a device and system to secure textiles to fixed surfaces and will hold the textile stationary.

BRIEF DESCRIPTION OF THE DRAWINGS

A device and system to secure textiles to fixed surfaces is illustrated by way of example, and not by way of limitation, in the figures of the accompanying drawings.

While aspects of a device and system to secure textiles to fixed surfaces will be described with reference to the details of the embodiments of the invention shown in the drawings (and some embodiments not shown in the drawings), these details are not intended to limit the scope of the invention.

LIST OF FIGURE ITEMS

Figure 1:
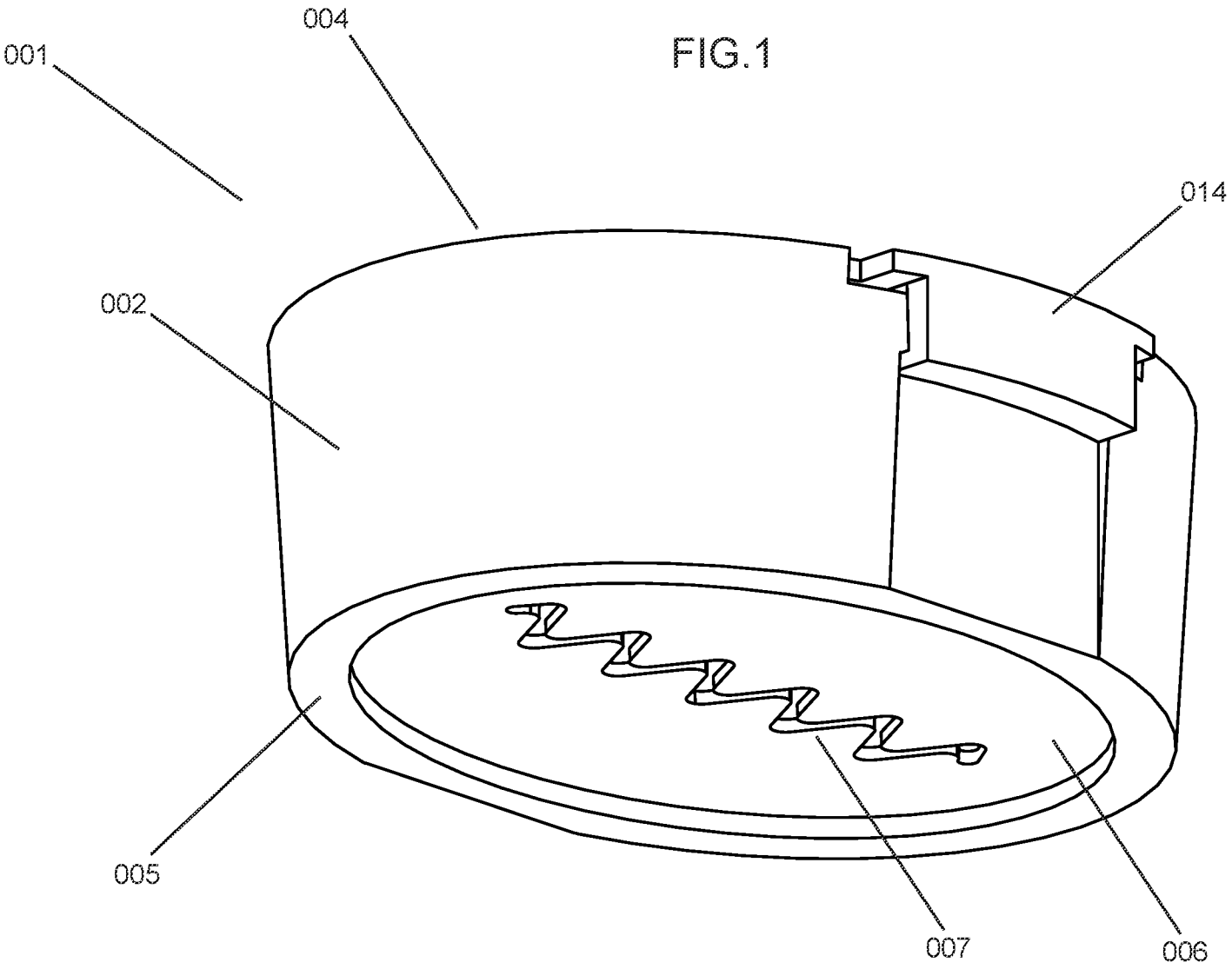
FIG. 1. An underside perspective view of a device and system to secure textiles to fixed surfaces.

000 A device and system to secure textiles to fixed surfaces
001 A holder assembly
002 A body
003 A cover
004 A top
005 A bottom
006 A malleable material
007 An opening means
008 A fastener
009 A receiver
010 A straight edge brush
011 A round brush
012 A table
013 A tablecloth

DETAILED DESCRIPTION

The order of the steps in the disclosed processes may be altered within the scope of the invention.

In conjunction with the accompanying drawings, the following detailed description provides a more specific and detailed explanation of various embodiments of the device and system to secure textiles to fixed surfaces. These embodiments are provided to illustrate the invention but should not be seen as limiting its scope; the invention can be embodied in many different forms and is intended to be thorough and comprehensive to those skilled in the art.

For the purposes of promoting an understanding of the principles of a device and system to secure textiles to fixed surfaces, reference will now be made to the embodiments illustrated in the drawings and specific language will be used to describe the same, only as examples and not intended to be limiting.

A textile may come in varying sizes and shapes, including but not limited to round, square, rectangle, oval, hexagon, octagon, and irregular shapes.

A textile may be made of various materials, including but not limited to linen, cotton, polyester, silk, organza, vinyl (PVC or oilcloth), plastic, paper, tissue paper, and other woven or non-woven materials.

A textile may be, but is not limited to, a tablecloth. A tablecloth as used herein may be, but not limited to, a fabric cover intended for placement on a table, which may include tablecloths, table skirting, and table runners.

A fixed surface may be, but is not limited to, a table. A table, as used herein, may be of various types, including but not limited to a dining table, glass table, wood table, plastic table, indoor table, outdoor table, coffee table, picnic table, end table, camping table, folding table, slatted table, and other types of tables commonly known in the art. The table may have different shapes, sizes, materials, and features, and can be used in various settings.

Disclosed is a device and system to secure textiles to fixed surfaces, comprising the following components: (1) a holder assembly 001; (2) a body 002; (3) a cover 003; (4) a malleable material 006; (5) an opening means 007; (6) a fastener 008.

These components, generally speaking, are configured as follows: (1) a holder assembly 001 has a top 004 and a bottom 005 (2) a body 002 has a malleable material 006 connected to the bottom 005 of the body 002; (3) a cover 003 is connected to the body 002; (4) the malleable material 006 has an opening means 007 to receive a textile; (5) the opening means 007 is a longitudinal slit and the opening style the slit may be zigzag; (6) a fastener 008 is attached to the cover 003 to allow the entire holder assembly to connect to a fixed surface.

A device and system to secure textiles to fixed surfaces may also have one or more of the following: (1) a brush-like 010, 011 mechanism in place of a malleable material 006 on the bottom 005 of a body 002; (2) an indentation in the cover to receive 009 an adhesive peel-and-stick tab.

The disclosed device and system to secure textiles to fixed surfaces is unique when compared with other known devices and solutions because it provides: (1) for easy one-handed operation; (2) is reusable; (3) has no modification requirements to a textile; (4) supports fixed surfaces and textiles of varying sizes; (5) the disclosed device may be of varying sizes.

The disclosed device and system to secure textiles to fixed surfaces is unique in that it is structurally different from other known devices or solutions. More specifically, the device is unique due to the presence of (1) a holder assembly of a size that can be adapted to different tablecloths; (2) a malleable material made of different materials to handle different tablecloth materials.

In some embodiments of versions of a device and system to secure textiles to fixed surfaces, a holder assembly 001; a body 002; a cover 003; a malleable material 006 may be a single component.

In some embodiments of versions of a device and system to secure textiles to fixed surfaces, a holder assembly 001; a body 002; a cover 003; a malleable material 006 may be separate components.

In some embodiments of versions of a device and system to secure textiles to fixed surfaces a holder assembly 001; a body 002; a cover 003; a malleable material 006 may be connected via adhesives, a plurality of fasteners, a combination of joints and adhesives.

In some embodiments of versions of a device and system to secure textiles to fixed surfaces, a body 002 and a cover 003 are connected by a connection means 014. A connection means may be, but is not limited to, a snap-fit joint, or adhesive.

In some embodiments of versions of a device and system to secure textiles to fixed surfaces, a body 002 and a cover 003 may be similarly shaped and nearly identical in size wherein the cover 003 is specifically designed to fit snugly into the body 002, forming a unified unit. The purpose of this design is to securely hold a flexible malleable material 006 in position.

In some embodiments of versions of a device and system to secure textiles to fixed surfaces a holder assembly 001 may vary in size, for example, and not meant to be limiting, having a length of 3.8 cm to 15.2 cm (approximately 1.5 inches to 6 inches), a width of 2.5 cm to 10 cm (approximately 1 inches to 4 inches) and a height of 0.5 cm to 5 cm (approximately ½ inch to 2 inches).

In some embodiments of versions of a device and system to secure textiles to fixed surfaces a holder assembly 001 may be, but not limited to, one of the following shapes such as oval, square, rectangle, pentagon, octagon, circle, triangle, hexagon, heptagon, nonagon, decagon, and irregular shapes.

In some embodiments of versions of a device and system to secure textiles to fixed surfaces a holder assembly 001 body 002 and cover 003 be made of materials like, but not limited to, metal, plastic, polystyrene resin, fiberglass, carbon fiber, rubber, foam, PVC (polyvinyl acetate), EVA (ethylene-vinyl acetate), high density polyethylene (HDPE), wood, bamboo, natural fibers (such as jute or hemp), synthetic fibers (such as nylon or polyester), and recycled or eco-friendly materials.

In some embodiments of versions of a device and system to secure textiles to fixed surfaces a malleable material 006 may be made of materials like, but not limited to, silicon, rubber, plastic, nylon, neoprene, fabric, leather, paper, felt, and cork.

In some embodiments of versions of a device and system to secure textiles to fixed surfaces an opening means 007 may have an opening style like, but not limited to, smooth, serrated, zigzag, jagged, wavy, ribbed, grooved, scalloped, and straight.

In some embodiments of versions of a device and system to secure textiles to fixed surfaces, an opening means 007 may have a longitudinal slit and an intersecting slit.

In some embodiments of versions of a device and system to secure textiles to fixed surfaces, a malleable material 006 may be replaced by a pair of brushes 010,011. These brushes 010,011 can be made of various materials, but when used together, they create an opening means 007 through which a textile can be secured.

In some embodiments of versions of a device and system to secure textiles to fixed surfaces the opening means 007 is a pair of straight edge brushes 010 designed to grasp and hold textiles in place.

In some embodiments of versions of a device and system to secure textiles to fixed surfaces the opening means 007 is a pair of round brushes 011 designed to grasp and hold textiles in place.

In some embodiments of a device and system for securing textiles to fixed surfaces, either brushes or a malleable material can be used independently or in combination as means to create openings to receive a textile.

In some embodiments of versions of a device and system to secure textiles to fixed surfaces a brush 010, 011 may be made of, but not limited to, metal, nylon, boar bristle, horsehair, and goat hair.

In some embodiments of versions of a device and system to secure textiles to fixed surfaces a fastener 008 may be a suction cup, a hook and loop fastener, an adhesive tab, a screw, a pair of magnets, snaps, buckles, clasps, buttons, clips, zippers, pins, and toggles.

Possible embodiments are listed as examples, not meant to be limiting: a suction cup may be mounted to a cover 006 and secured to a table, like glass; a hook and loop fastener may have one element secured to a cover 006 and the other element affixed to a table; a screw may be screwed with a washer and screw through a cover 006 into a table; an adhesive peel-and-stick tab may have a liner on its opposite side removed by a user and a cover 006 is then secured to a table.

A preferred embodiment, not meant to be limiting, is a holder assembly 001 with a top 004 and a bottom 005 that has a malleable material 006 connected to the bottom of a body 002. A cover 003 with a snap-fit joint means is connected to the body 002 to hold the two parts securely together. The cover 003 has an indentation in the top of the cover 002 to receive an adhesive peel-and-stick tab. The malleable material 006 has a zigzag slit to allow a textile to pass into it.

In FIG. 1 an embodiment of an underside perspective view of a device and system to secure textiles to fixed surfaces is shown. A malleable material 006 has a zig-zag style opening means 007. The bottom 005 and top 004 of the assembly 001 are shown to give a possible embodiment orientation. The body 002 is shown with the snap-fit joint of the cover in place. The malleable material is connected to the bottom of the body 002.

Figure 2:
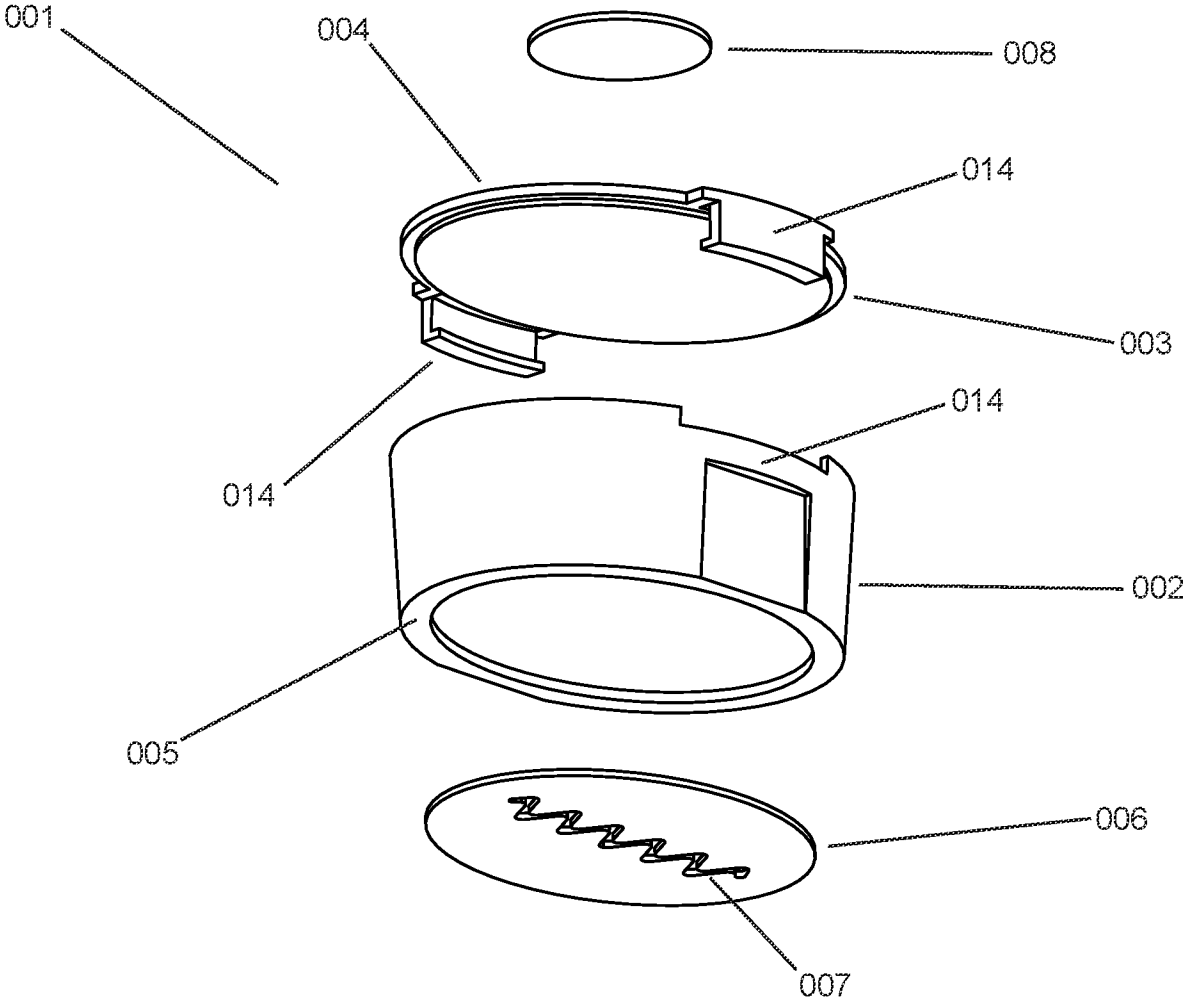
FIG. 2. An underside perspective exploded view of a device and system to secure textiles to fixed surfaces.
Figure 3:
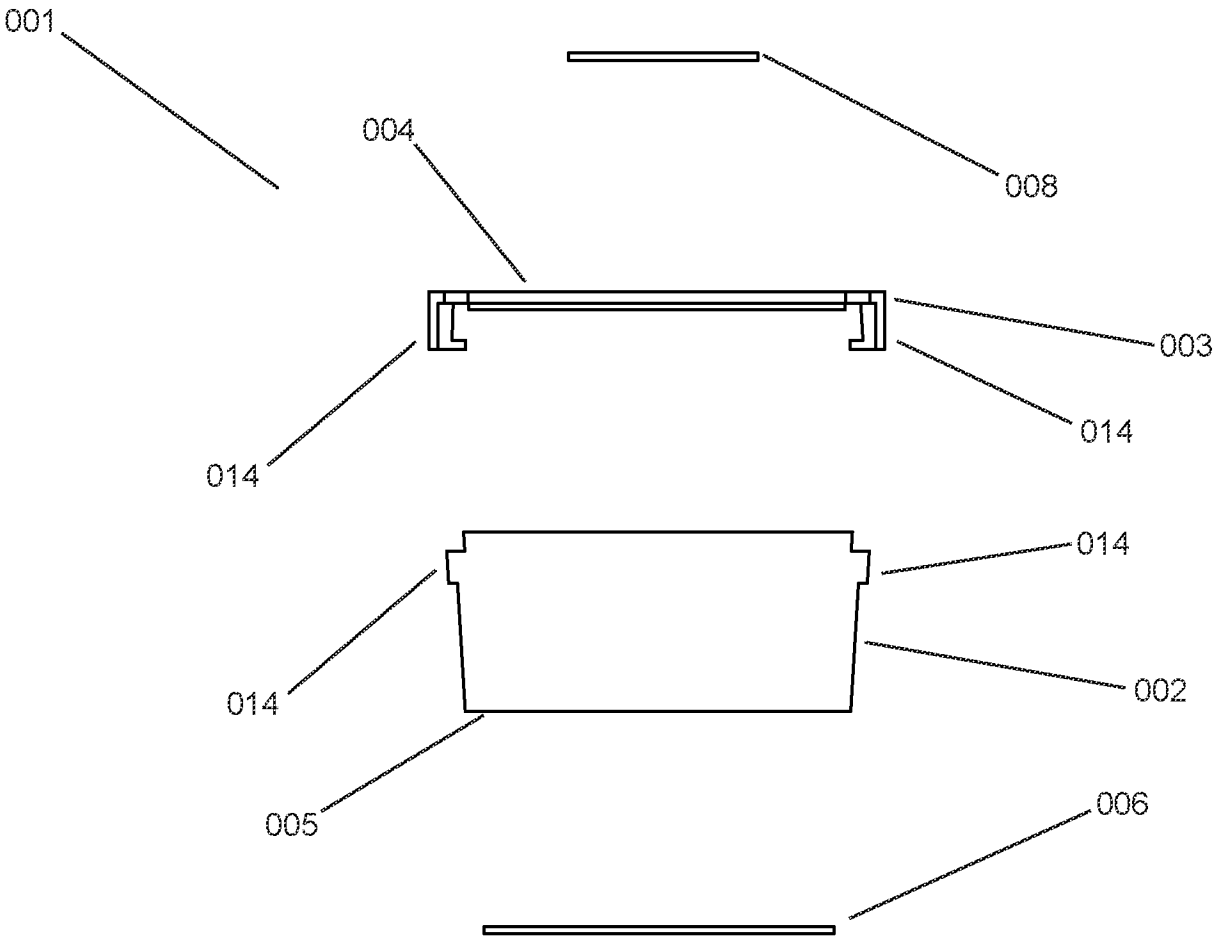
FIG. 3. A side exploded view of a device and system to secure textiles to fixed surfaces.

In FIG. 2 an underside perspective exploded view and FIG. 3 a side view of a possible embodiment of a device and system to secure textiles to fixed surfaces is shown. A malleable material 006 has a zig-zag style opening means 007. The bottom 005 is shown referenced to the body 002 and the top 004 is referenced to the cover 003 of the assembly 001 are shown to give a possible embodiment orientation. The body 002 is shown without the snap-fit joint of the cover 003 in place. A possible style of an adhesive peel-and-stick tab 008 is shown.

Figure 4:
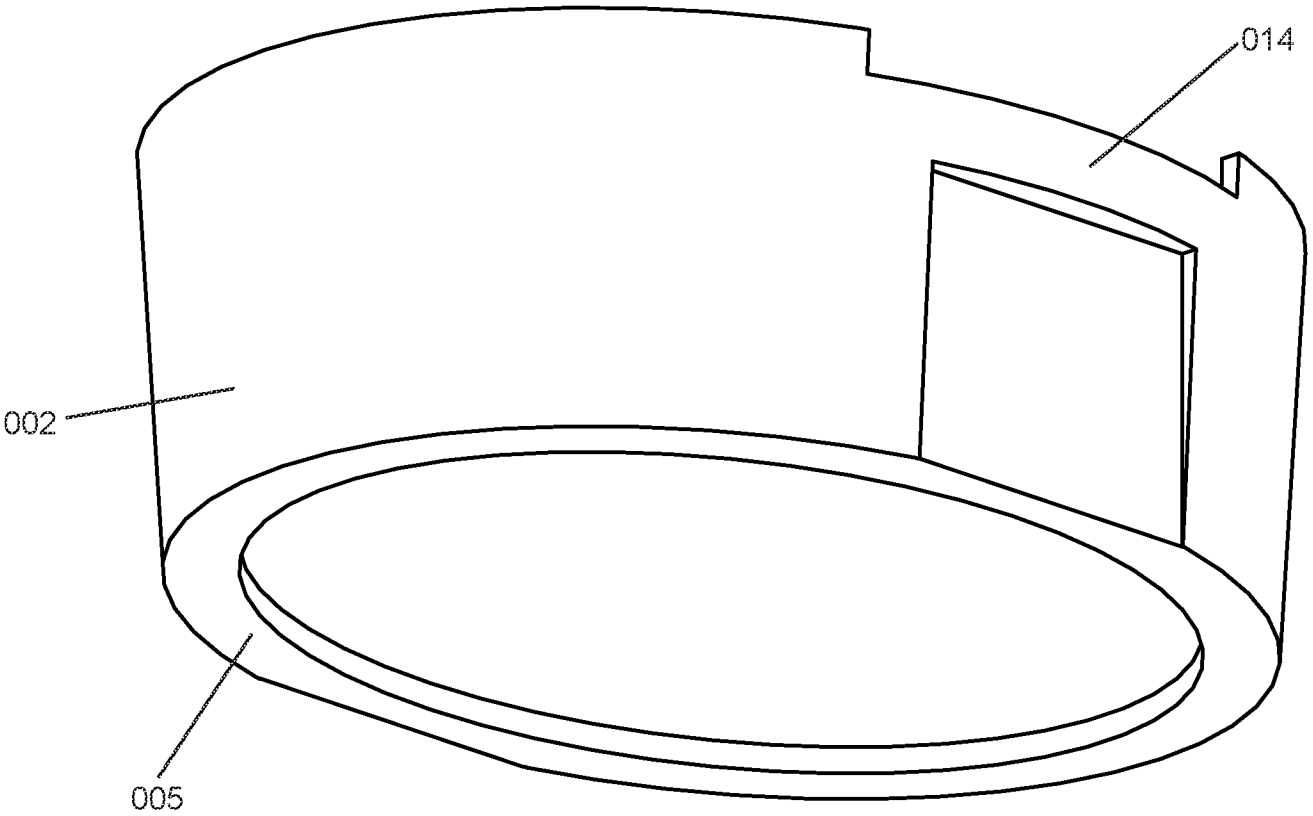
FIG. 4. An underside perspective view of the body of a device and system to secure textiles to fixed surfaces.

FIG. 4 shows an underside perspective view of the body 002 of a device and system to secure textiles to fixed surfaces is shown without the malleable material 006. The particular embodiment shown has notches to receive a snap-fit cover although other embodiments may use alternative connection means.

Figure 5:
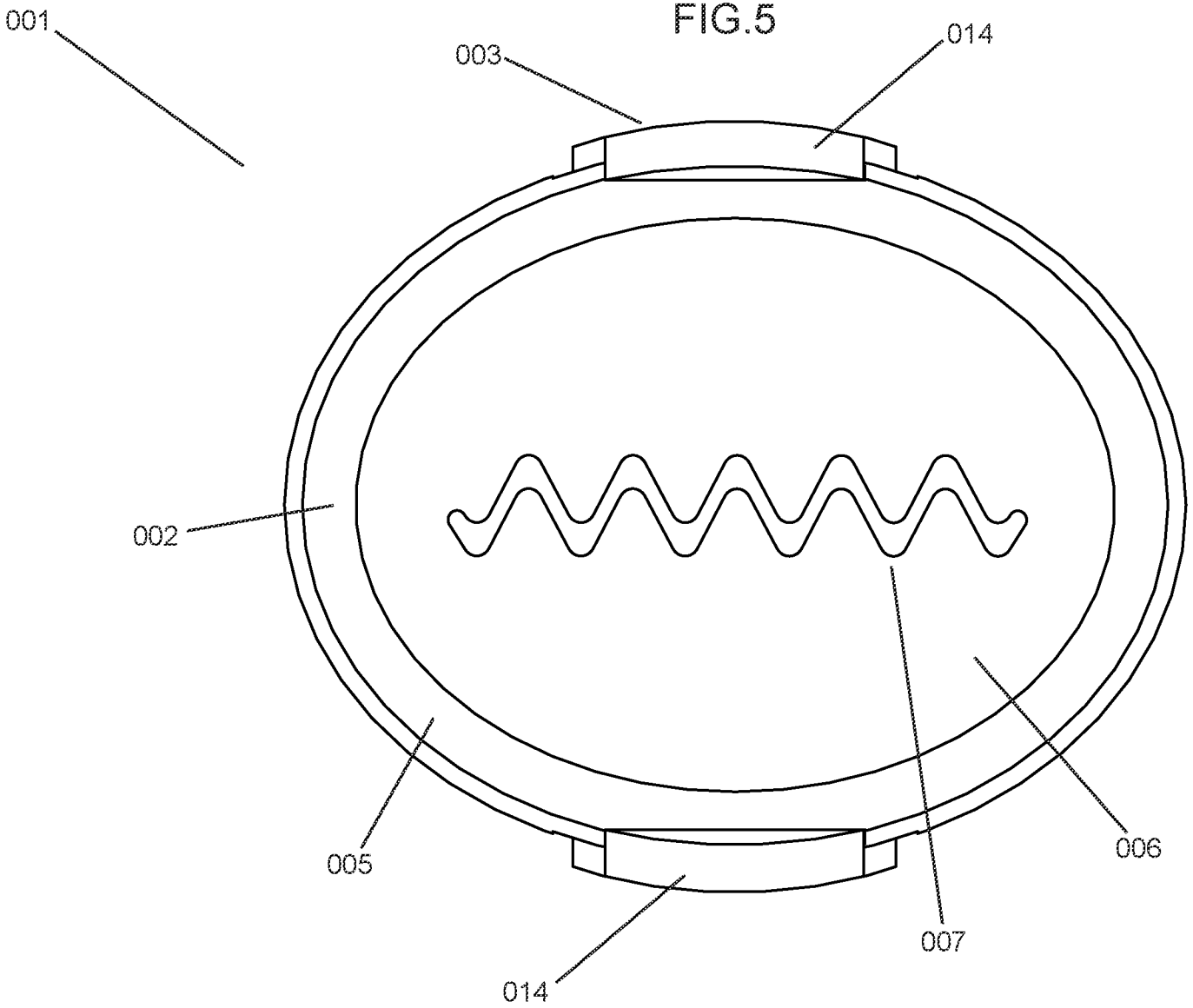
FIG. 5. A bottom view of the body of a device and system to secure textiles to fixed surfaces.

FIG. 5 is a bottom view of the body 002 of a device and system to secure textiles to fixed surfaces with a malleable material 006 connected to the bottom 005 of the body 002. The cover 003 snap-fit joint means can be seen in this particular embodiment.

Figure 6:
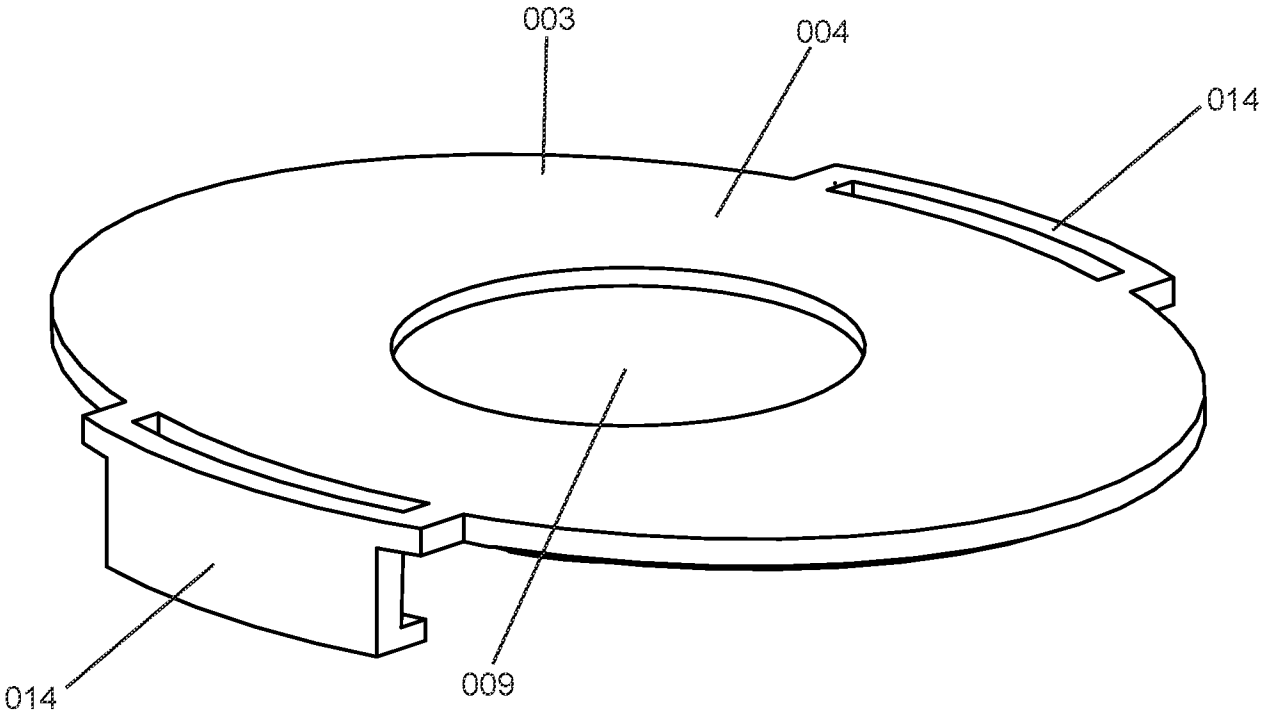
FIG. 6. A perspective view of the cover of a device and system to secure textiles to fixed surfaces.
Figure 8:
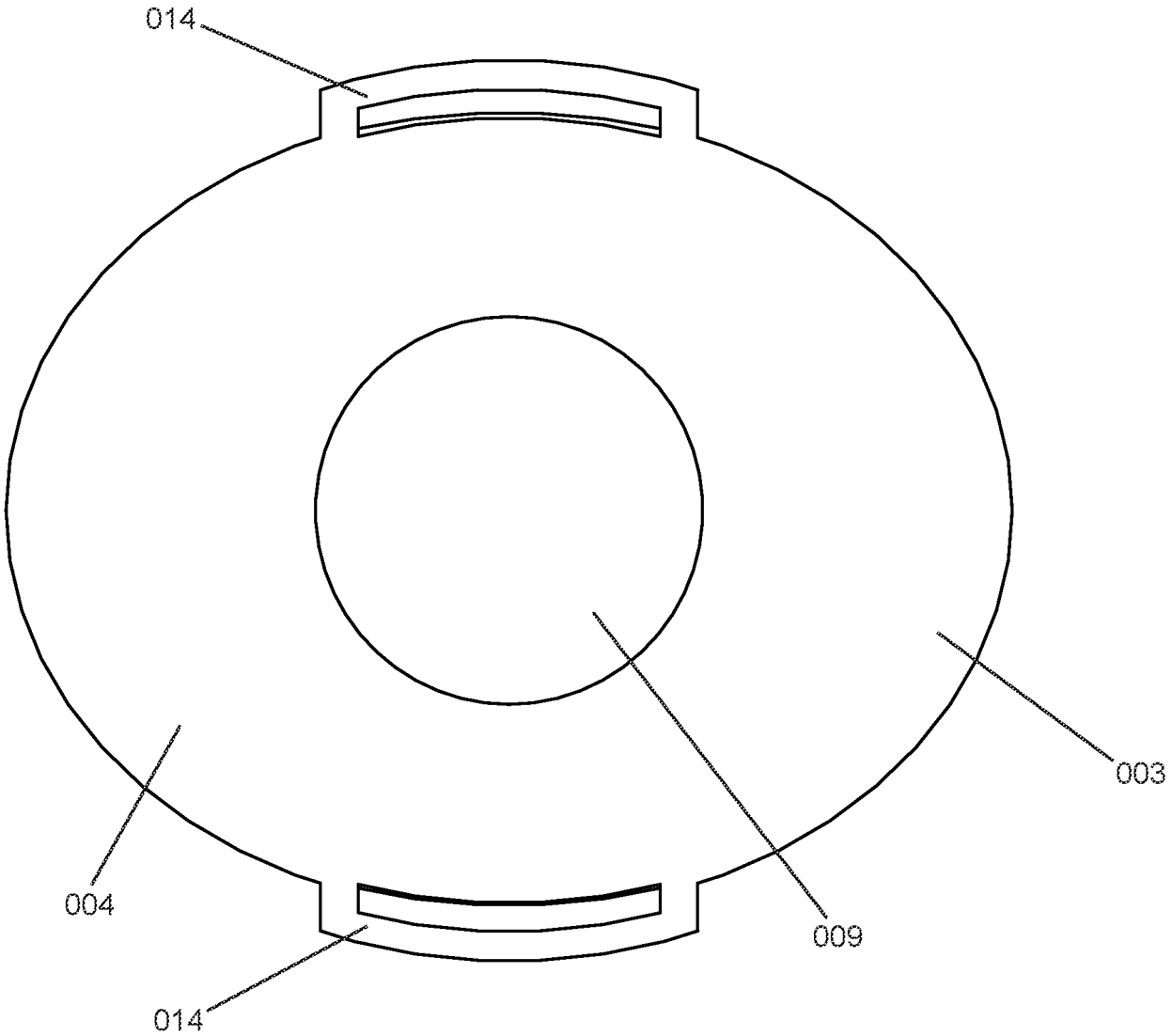
FIG. 8. A top view of the cover of a device and system to secure textiles to fixed surfaces.

FIG. 6 is a perspective view and FIG. 8 is a top view of the cover 003 of a device and system to secure textiles to fixed surfaces is shown with a receiver 009 in the top 004 of the cover 003 for an adhesive peel-and-stick tab. Some embodiments of a device and system to secure textiles to fixed surfaces may not have a receiver 009 in the top 004 of the cover 003.

Figure 7:
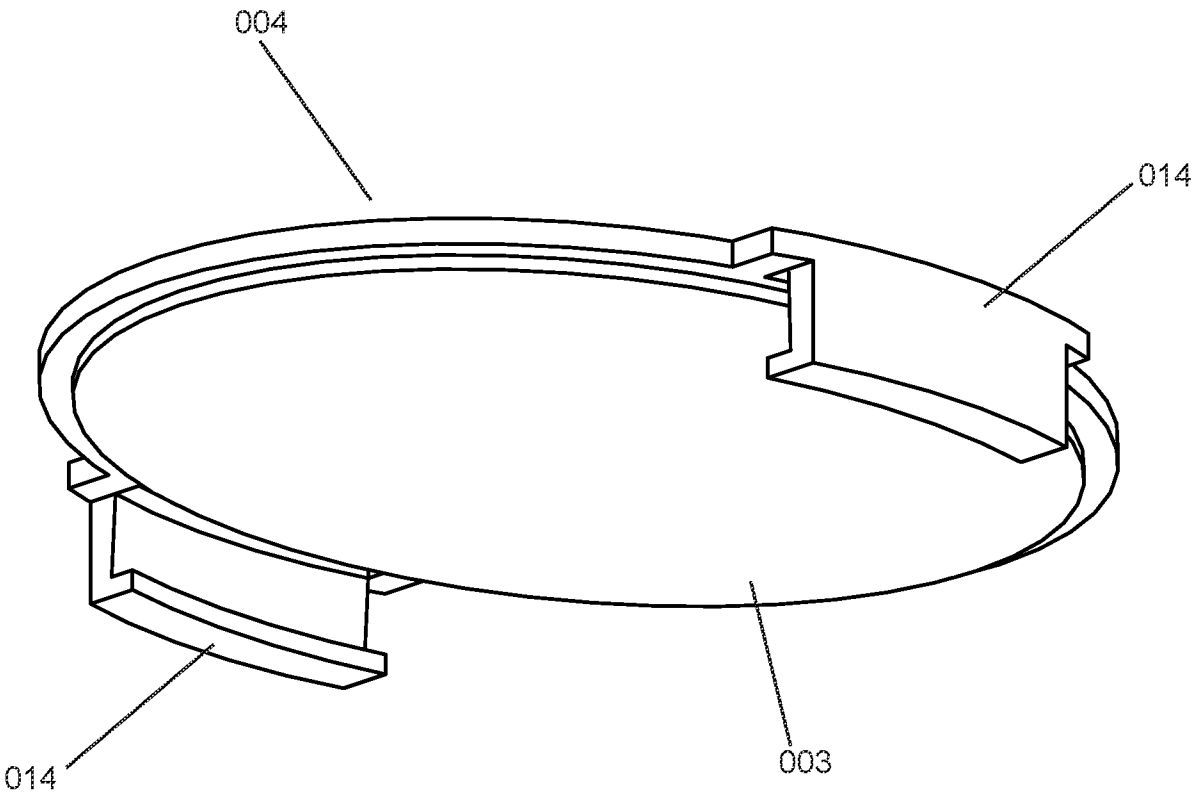
FIG. 7. An underside perspective view of the cover of a device and system to secure textiles to fixed surfaces.
Figure 9:
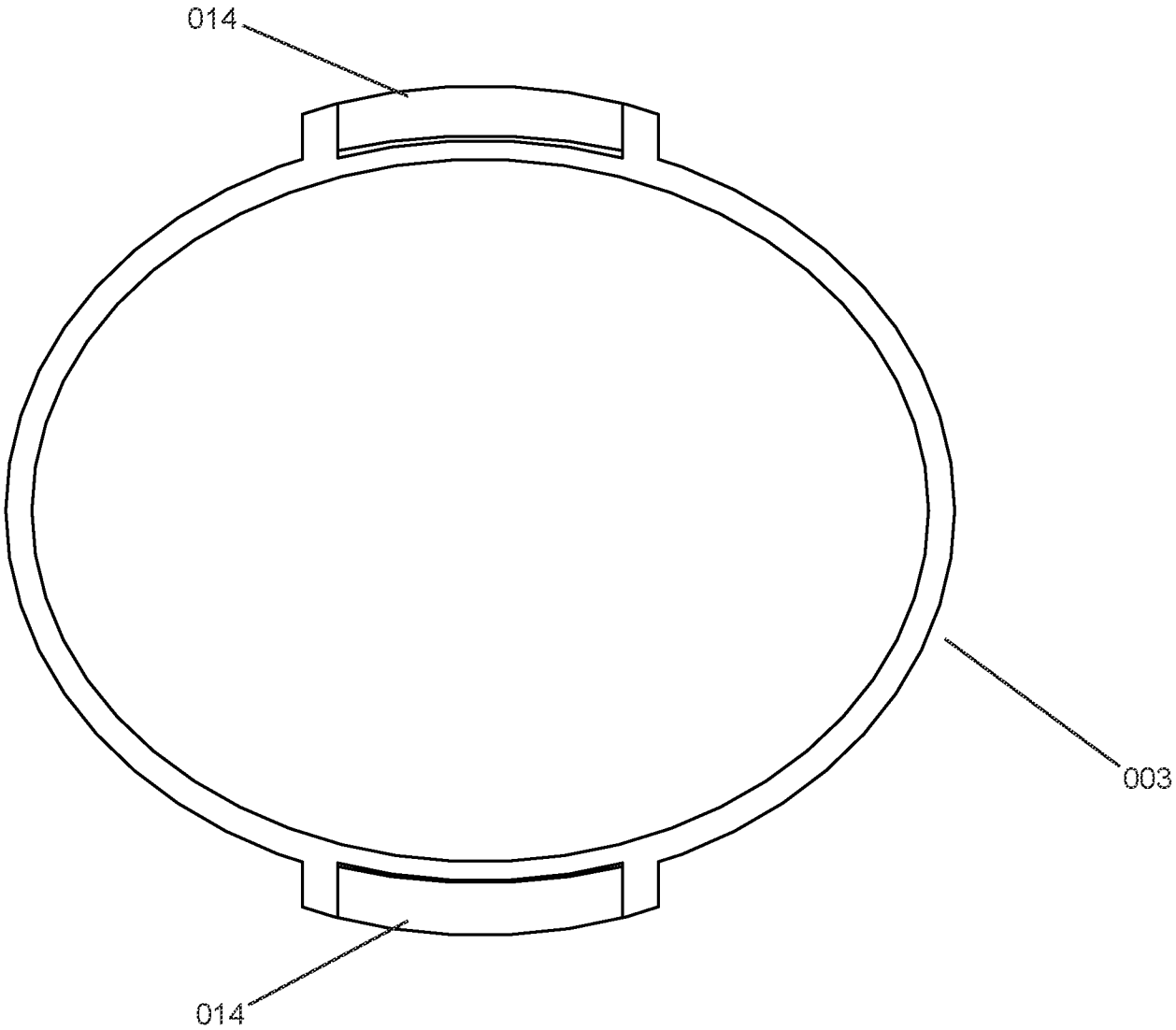
FIG. 9. A bottom view of the cover of a device and system to secure textiles to fixed surfaces.

FIG. 7 is an underside perspective view and FIG. 9 is a bottom view of the cover 003 of a device and system to secure textiles to fixed surfaces.

Figure 10:
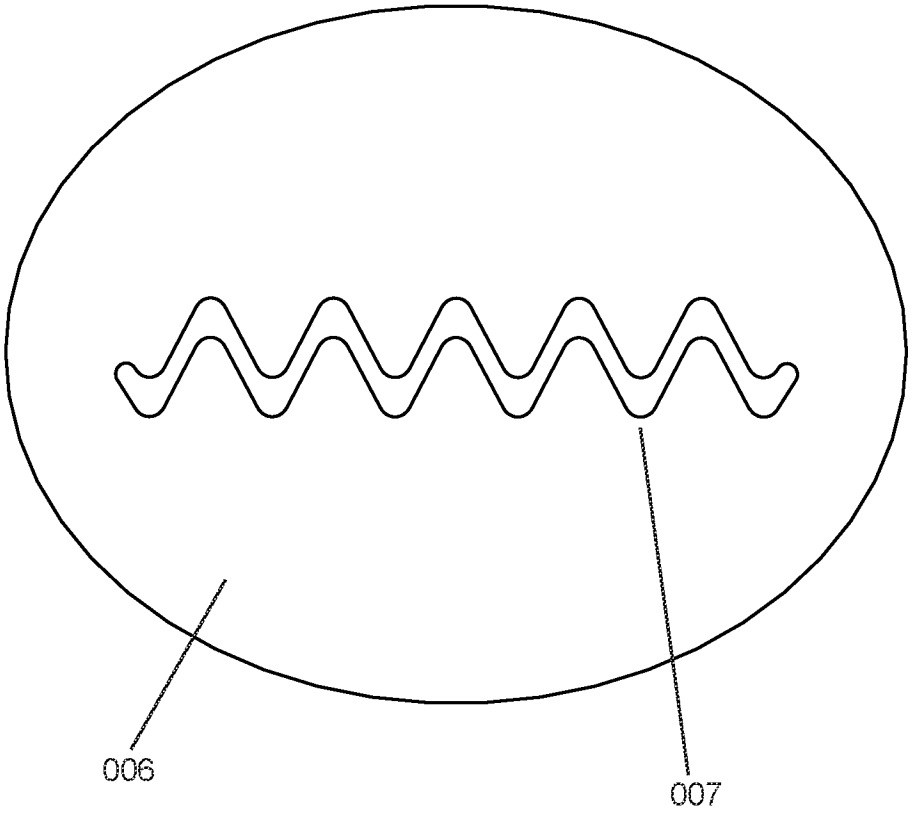
FIG. 10. A bottom view of the malleable material of a device and system to secure textiles to fixed surfaces.
Figure 11:
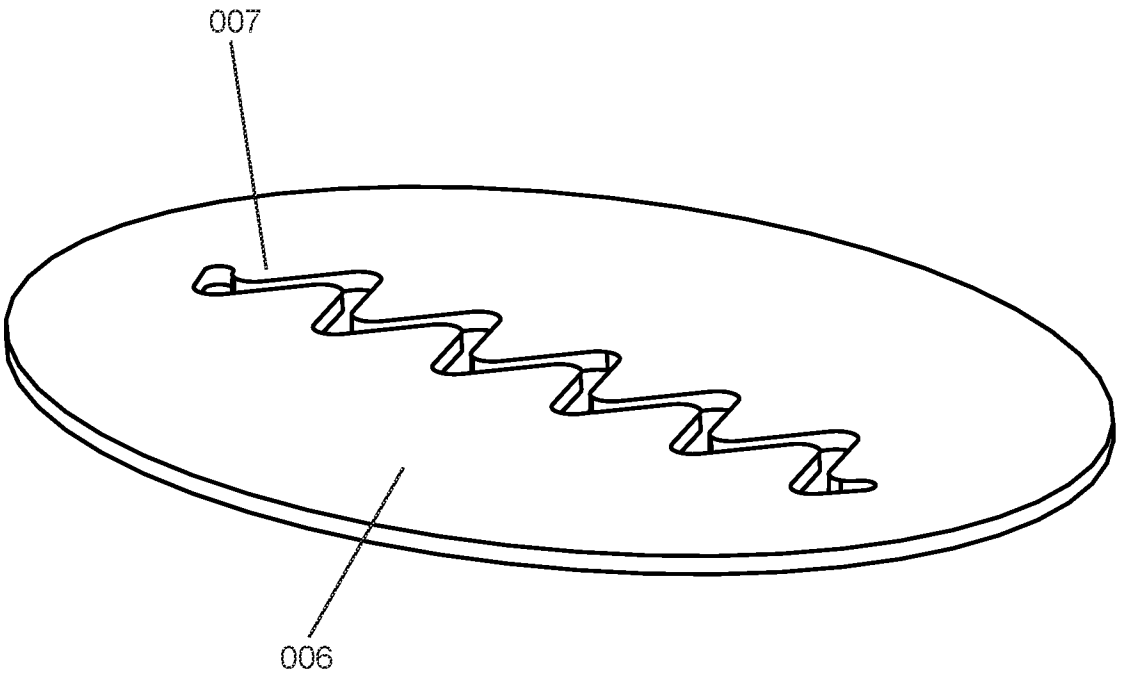
FIG. 11. A perspective view of the malleable material of a device and system to secure textiles to fixed surfaces.

FIG. 10 is a bottom view and FIG. 11 is a perspective view of the malleable material of a device and system to secure textiles to fixed surfaces showing an opening means 007 of a zig-zag style.

Figure 12:
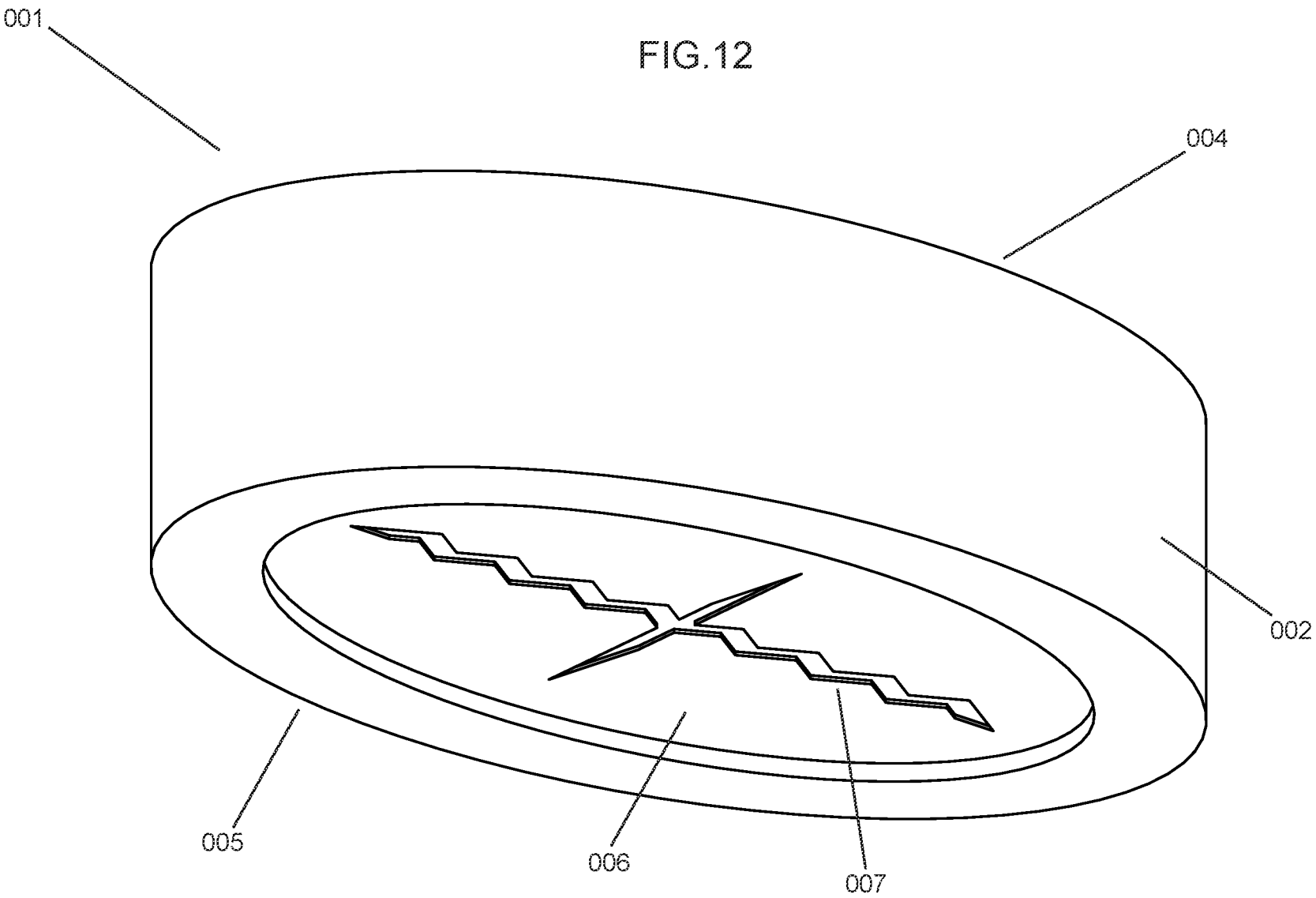
FIG. 12. An underside perspective view of the body of an alternative embodiment of a device and system to secure textiles to fixed surfaces.
Figure 13:
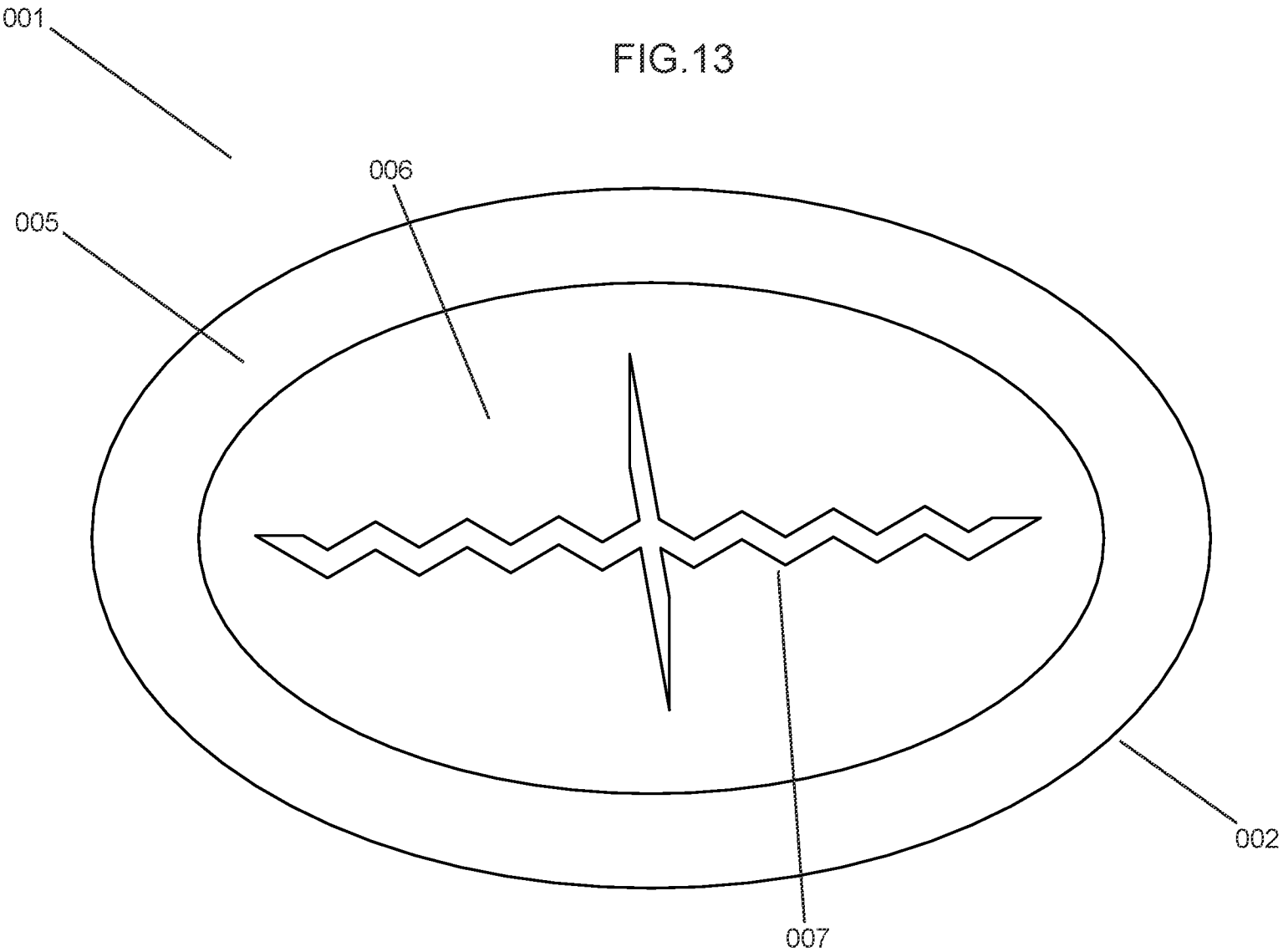
FIG. 13. A bottom view of the body of an alternative embodiment of a device and system to secure textiles to fixed surfaces.

FIG. 12 is an underside perspective view and FIG. 13 is a bottom view of an alternative embodiment with a snugly fit body 002 and cover 003 of a device and system to secure textiles to fixed surfaces showing a holder assembly 001 with a bottom 005 wherein the bottom has a malleable material 002 to receive a textile. The malleable material 006 has a longitudinal slit and an intersecting slit to create an opening means 007 whereby a textile may be pushed up and into the opening means 007 to hold a textile securely in place.

Figure 14:
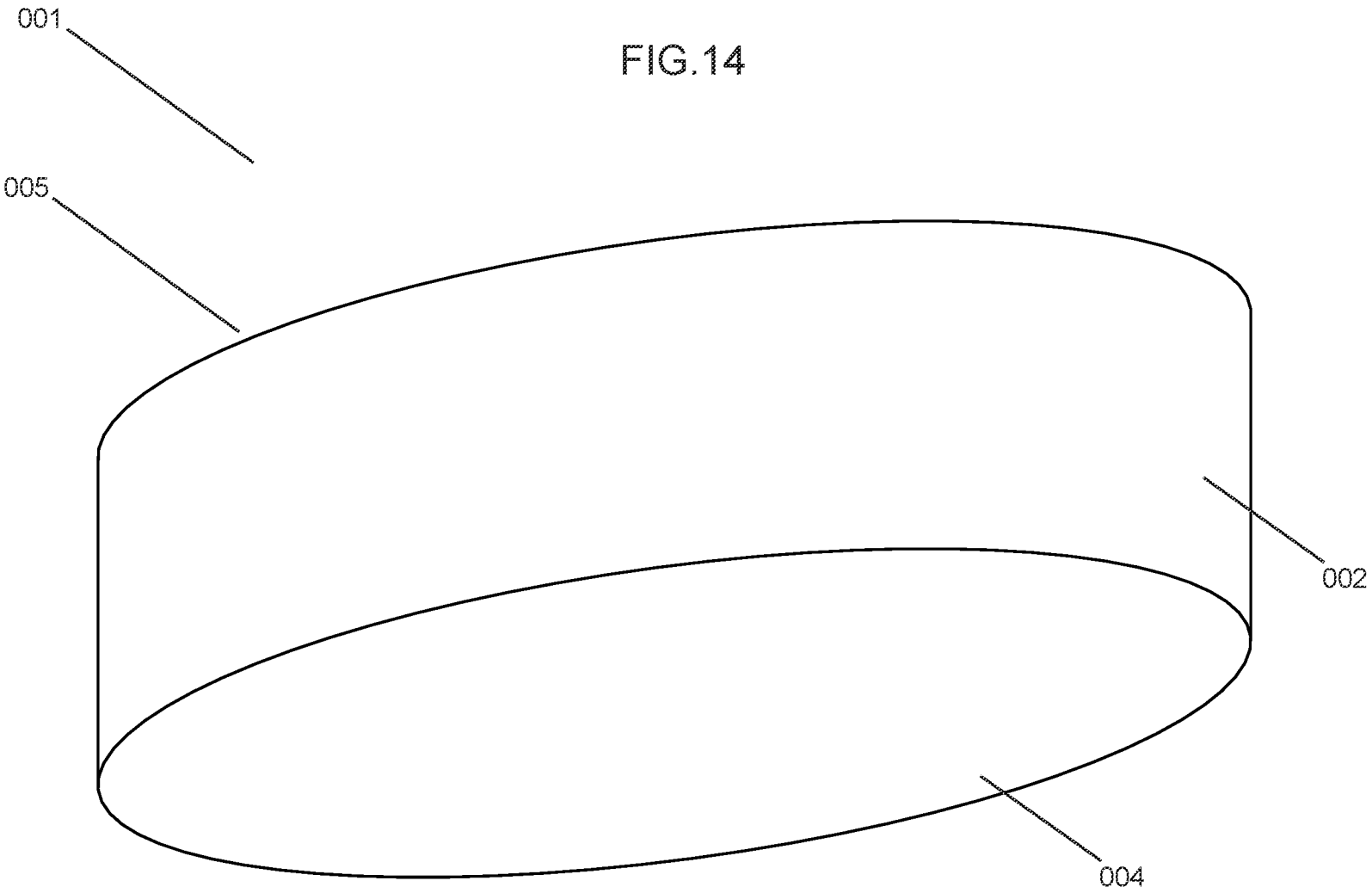
FIG. 14. A perspective view of the cover of an alternative embodiment of a device and system to secure textiles to fixed surfaces.

FIG. 14. is a perspective view of a cover 004 to fit snugly into a body 002.

Figure 15:
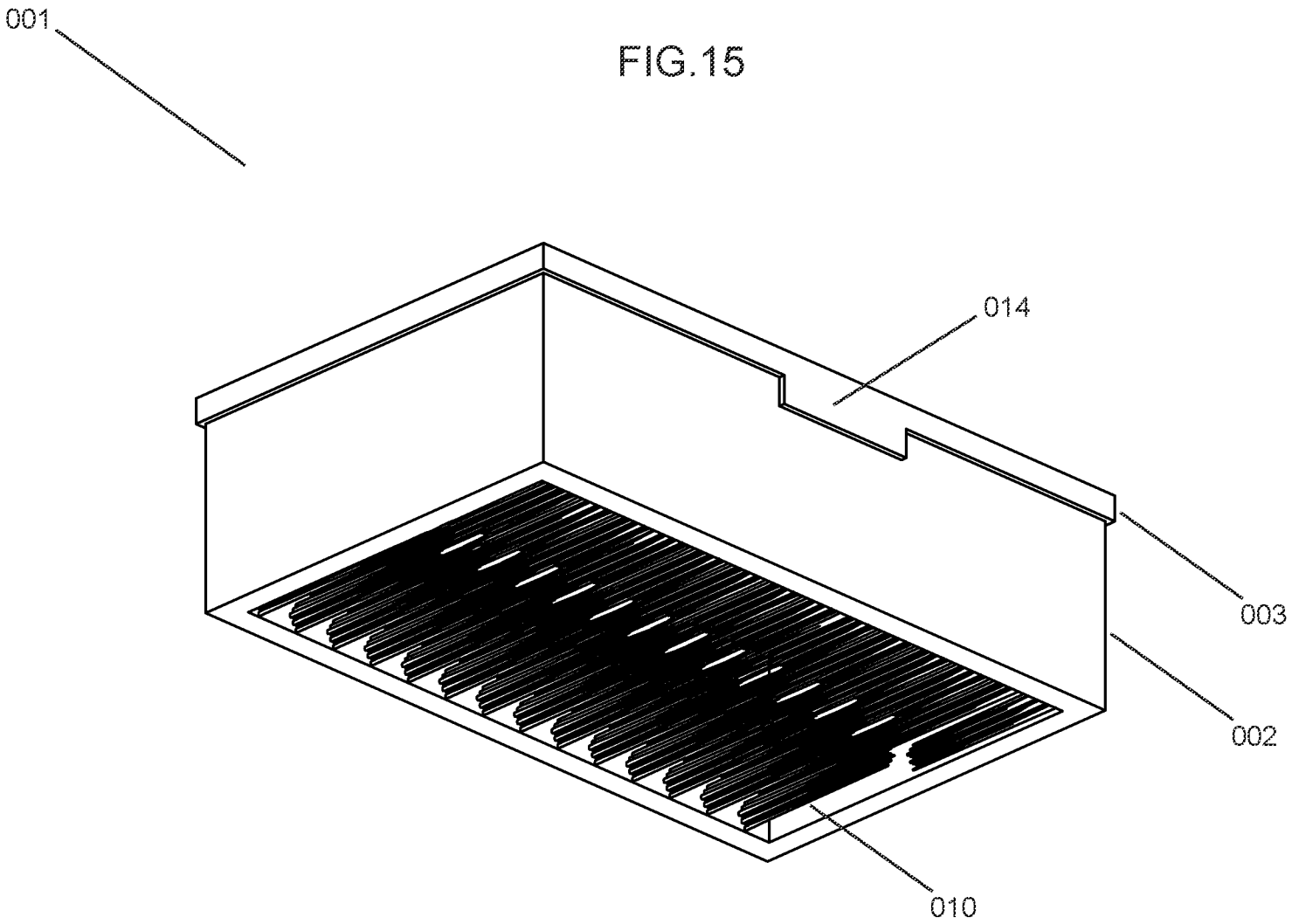
FIG. 15. A perspective view of the cover of an alternative embodiment of a device and system to secure textiles to fixed surfaces. The alternative embodiment is rectangular shape and has round brushes to create an opening means.
Figure 16:
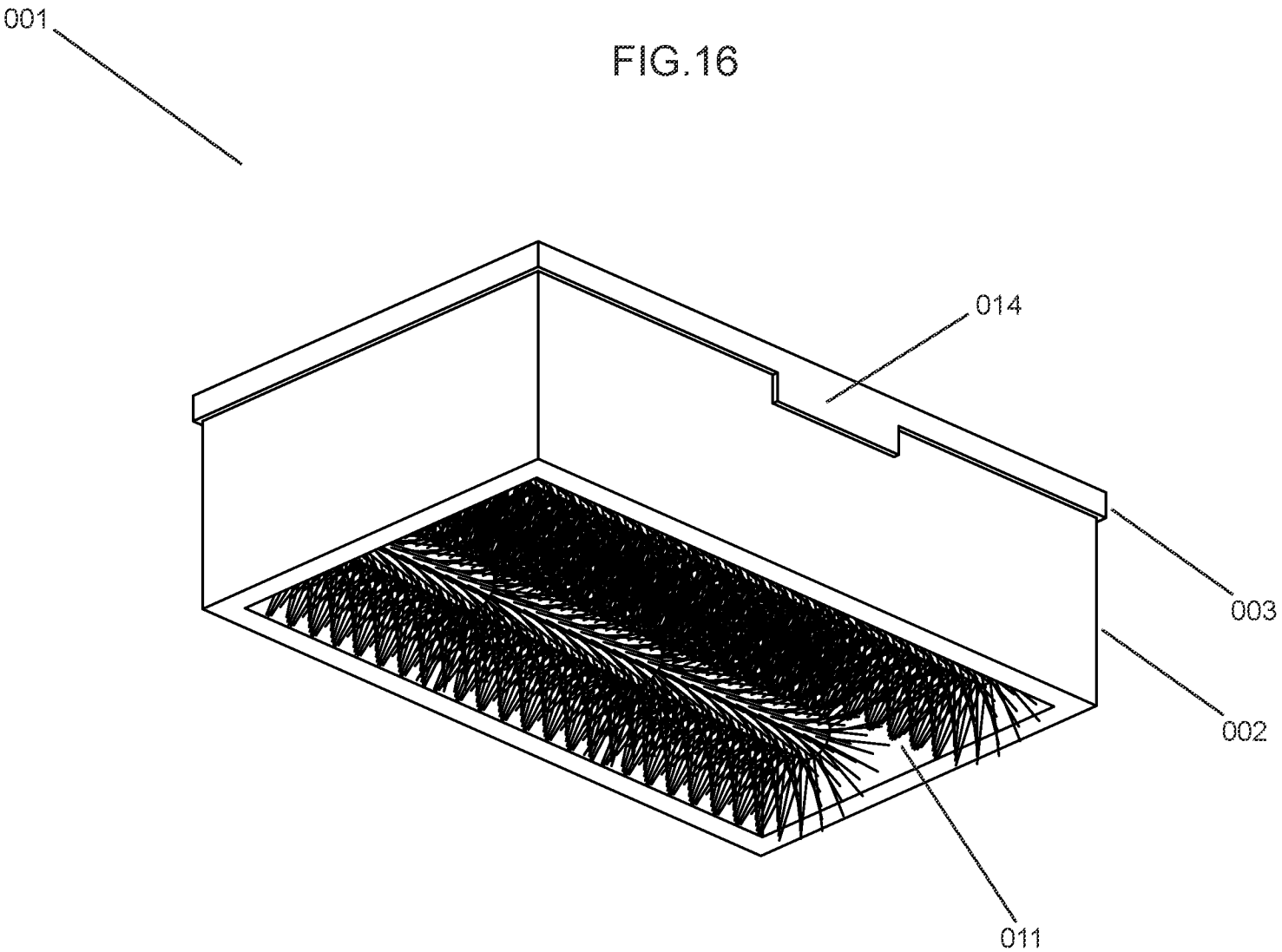
FIG. 16. A perspective view of the cover of an alternative embodiment of a device and system to secure textiles to fixed surfaces. The alternative embodiment is rectangular shape and has straight edge brushes to create an opening means.

Another option for the design is illustrated in FIG. 15 and FIG. 16, where both figures provide a perspective view from below. In these alternative embodiments, the holder assembly 001 has a rectangular shape. Similar to the other designs, a cover 003 is connected to a body 002 using a connection mechanism, and it also includes a fastening mechanism to attach it to a fixed surface. Additionally, there are a pair of brushes, labeled as 010 in FIGS. 15 and 011 in FIG. 16. These brushes 010, 011 serve as an opening through which a textile can be inserted, securing it firmly in place.

Figure 17:
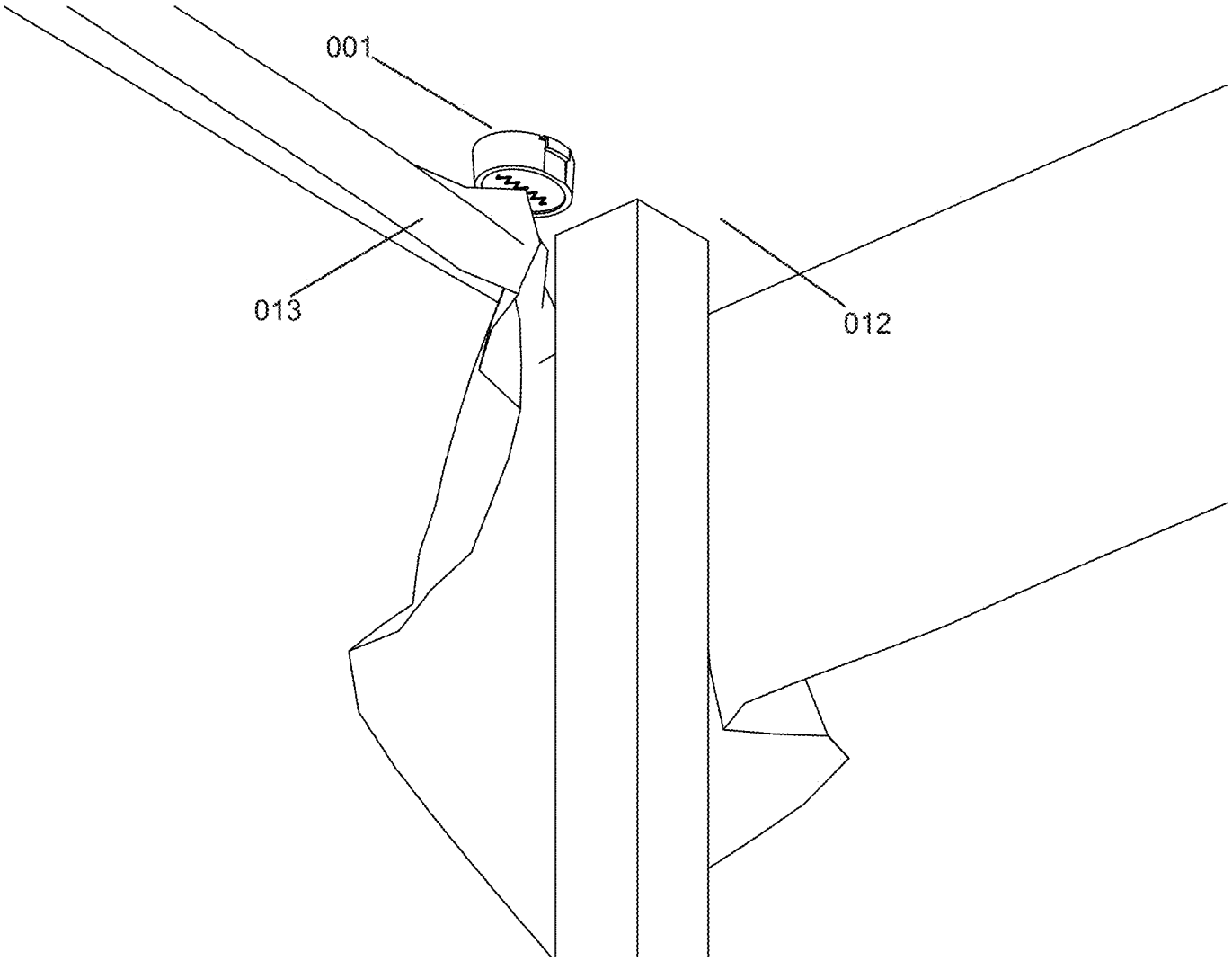
FIG. 17. A perspective view of an embodiment of a device and system to secure textiles to fixed surfaces attached to the underside of a hypothetical table with a tablecloth inserted.
Figure 18:
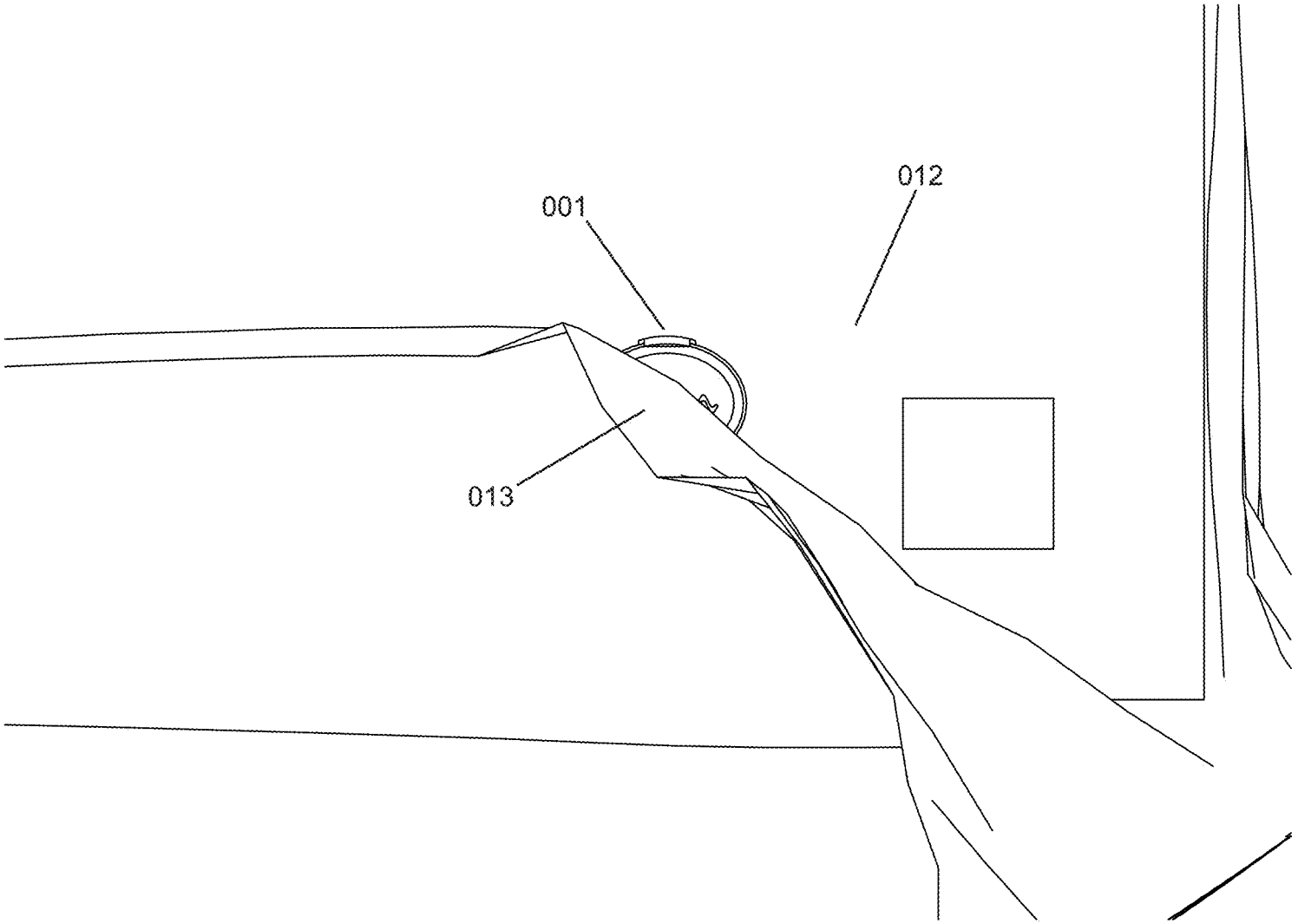
FIG. 18. A bottom view of an embodiment of a device and system to secure textiles to fixed surfaces attached to the underside of a hypothetical table with a tablecloth inserted.

An example of a possible embodiment is shown in FIG. 17 and FIG. 18 where FIG. 17 is an underside perspective view and FIG. 18 is a bottom view of a fixed surface 012, such as a table. In the figures, holder assembly 001 is attached to the underside of the fixed surface 012. Next, a textile 013, such as a tablecloth, is drawn into the holder assembly 001 and inserted through the opening means in the bottom of the holder assembly. There is no limitation as to what part of the textile, for instance the corner, an edge, or gathering, is inserted.

Although all embodiments of the device for securely attaching a textile to a fixed surface have referenced the underside of a fixed surface, there is no limitation as to whether the holder assembly could be attached to a vertical surface, for instance to hold a towel.

A version of the device is a method for securely attaching a textile to a fixed surface. The method involves the following steps: providing a holder assembly with specific dimensions (length, width, height, and thickness), where each holder assembly has a malleable material connected to its bottom and an opening means; attaching a fastener to the top of the holder assembly to secure it to the fixed surface; selecting a suitable fixed surface and textile; securing each holder assembly to the underside of the surface; positioning the textile over the fixed surface; stretching the textile over the surface; and inserting the overhanging edges and flaps of the textile into the opening means of the holder assembly to securely attach the textile to the fixed surface. For best operation, the corners of the textile will be placed through the opening means and the holder assembly will typically be placed inward from the corners of the fixed surface in a manner that allows the textile to be pulled taut.

Versions of a device and system to secure textiles to fixed surfaces may be made individually, in batches, or via continuous assembly.

For instance, to create one possible embodiment of the device and system for securing textiles to fixed surfaces, prepare a suitable work surface and gather all the mentioned components. Assemble the components in a logical order, following the practices of a skilled person in the field. Begin by using a 3-D printer and an appropriate plastic resin to produce a holder assembly 001 according to the provided model. Print a second version of the holder assembly, larger than the first (holder assembly 001), to allow for insertion between the two. Stretch a silicon malleable material 006 over the inner holder assembly 001 and then insert it into the outer concentric holder assembly, the cover 003. Create a jagged longitudinal slit as an opening means 007 in the silicon material 006, followed by a short intersecting slit at a 90-degree angle to the first slit. The device and system for securing a tablecloth are now ready for use. Attach a fastening device, such as Velcro, adhesive, or screws, to the top of a table and insert the tablecloth into the opening means.

For instance, to create another possible embodiment of the device and system for securing textiles to fixed surfaces, prepare a suitable work surface and gather all the mentioned components. Assemble the components in a logical order, following the practices of a skilled person in the field. Begin by using a 3-D printer and an appropriate plastic resin to produce a holder assembly 001 with a body 002 of the appropriate size. Print a cover 003 to attach to the body 002. Before attaching the cover, insert a silicon malleable material 006 inside the body 002 and secure it with an adhesive. Attach the cover 003 to the body 002 with a connection means such as an adhesive. Create a jagged longitudinal slit as an opening means 007 in the silicon material 006. The device and system for securing a tablecloth are now ready for use. Attach a fastening device, such as an adhesive peel-and-stick tab. Insert the tablecloth into the opening means.

An example to use the assembled version of a device and system to secure textiles to fixed surfaces comprises affixing the device to the underside of a table and inserting a tablecloth into the opening means.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

The embodiments of a device and system to secure textiles to fixed surfaces may be utilized individually, concurrently, or in any sequential combination.

Those skilled in the art to which this application relates will appreciate that other and further additions, deletions, substitutions and modifications may be made to the described embodiments.

The specification is not to be taken in a limiting sense but is made merely for the purpose of describing the general principles of exemplary embodiments; many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

The invention is described with such embodiments, but the invention is not limited to any embodiment. The scope of the invention is limited only by the claims and the invention encompasses numerous alternatives, modifications and equivalents. Several specific details are set forth in the description to provide a thorough understanding of the invention. These details are provided for the purpose of example and the invention may be practiced according to the claims without some or all of these specific details. In general, the order of the steps of disclosed processes may be altered within the scope of the invention.

Unless otherwise indicated, the drawings are intended to be read (e.g., arrangement of parts, proportion, degree, etc.) together with the specifications, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" mean positioned or supported on but not necessarily in direct contact with the surface.

What is claimed is:

1. A device for securing a textile to a fixed surface, comprising:

a holder assembly of a given length, width, height, and shape with a top and a bottom;

wherein the holder assembly has a body and a cover, and the bottom of the holder assembly is the same as a bottom of the body, wherein the holder assembly further comprises an oval shape;

a malleable material;

an opening means;

a fastener;

wherein the malleable material is connected to the bottom of the body;

wherein the cover is connected to the body via a connection means;

wherein the malleable material is modified with the opening means;

wherein the opening means comprises a longitudinal slit with an opening style of serrations of a given angle and given distance; and wherein the fastener is connected to the cover to allow the holder assembly to attach to the fixed surface.

2. The device for securing a textile to a fixed surface of claim 1, wherein the connection means connecting the body and the cover is a snap-fit joint.

3. The device for securing a textile to a fixed surface of claim 1, further comprising a brush-like mechanism in place of the malleable material on the bottom of the body.

4. The device for securing a textile to a fixed surface of claim 1 wherein the fastener further comprising a fastener type selected from the group consisting of may be a suction cup, a hook and loop fastener, an adhesive tab, a screw, a pair of magnets, snaps, buckles, clasps, buttons, clips, zippers, pins, and toggles.

5. The device for securing a textile to a fixed surface of claim 1 wherein the holder assembly further comprising a shape selected from the group consisting of oval, square, rectangle, pentagon, octagon, circle, triangle, hexagon, heptagon, nonagon, decagon, and irregular shapes.

6. The device for securing a textile to a fixed surface of claim 1 wherein the holder assembly further comprising a material selected from the group consisting of plastic, metal, polystyrene resin, fiberglass, carbon fiber, rubber, foam, PVC (polyvinyl acetate), EVA (ethylene-vinyl acetate), high density polyethylene (HDPE).

7. The device for securing a textile to a fixed surface of claim 1 wherein the malleable material further comprising a material selected from the group consisting of silicon, rubber, plastic, nylon, neoprene, fabric, leather, paper, felt, and cork.

8. The device for securing a textile to a fixed surface of claim 1 wherein the opening style further comprising a shape selected from the group consisting of smooth, serrated, zig-zag, jagged, wavy, ribbed, grooved, scalloped, straight, and intersecting slits.

9. A method of using a plurality of devices for securing a textile to a fixed surface, comprising:

selecting a fixed surface for the devices for securing a textile to a fixed surface;

wherein the fixed surface has a plurality of corners;

selecting a textile with predefined length and width, having multiple corners;

selecting the devices for securing a textile to a fixed surface;

using each device for securing a textile to a fixed surface comprising: a holder assembly of a given length, width, height, and shape with a top and a bottom; wherein the holder assembly has a body and a cover and the bottom of the holder assembly is the same as a bottom of the body; a malleable material; an opening means; a fastener; wherein the malleable material is connected to the bottom of the body; wherein the cover is connected to the body via a fastening means; wherein the malleable material is modified with the opening means; wherein the fastener is connected to the cover to allow the holder assembly to attach to the fixed surface;

removing a liner from an opposite side of the fastener to expose an adhesive and attaching the adhesive to one of a plurality of corners of the fixed surface;

pushing one of the corners of the textile through the opening means of one of the devices; and resulting in the textile is held securely to the fixed surface.

* * * * *